US006836958B2

(12) United States Patent
Lee et al.

(10) Patent No.: US 6,836,958 B2
(45) Date of Patent: Jan. 4, 2005

(54) METHOD OF MAKING A PERMANENT MAGNET

(76) Inventors: Yong Lee, 16744 Septo St., North Hills, CA (US) 91343; Joseph Lee, 16744 Septo St., North Hills, CA (US) 91343

( * ) Notice: Subject to any disclaimer, the term of this patent is extended or adjusted under 35 U.S.C. 154(b) by 152 days.

(21) Appl. No.: 10/247,608

(22) Filed: Sep. 18, 2002

(65) Prior Publication Data

US 2003/0076206 A1 Apr. 24, 2003

Related U.S. Application Data

(62) Division of application No. 09/881,127, filed on Jun. 13, 2001, now abandoned.

(51) Int. Cl.[7] ..... H01F 7/06; H01F 1/03
(52) U.S. Cl. ..... 29/608; 335/302; 335/303
(58) Field of Search ..... 335/302–306; 29/602.1, 607, 608; 252/62.51 R, 62.51 C

(56) References Cited

U.S. PATENT DOCUMENTS 4,496,303 A * 1/1985 Loubier ..... 425/569
4,839,543 A * 6/1989 Beakley et al. ..... 310/12

* cited by examiner

*Primary Examiner*—Ramon M. Barrera
(74) *Attorney, Agent, or Firm*—Charles R. Sutton

(57) ABSTRACT

A Neodymium-Iron-Boron permanent magnet which is substantially wider across a first axis than across the perpendicular second axis. The second axis is the axis defining the north and south poles of the magnet. At one of the poles is a permalloy cap which is substantially parallel to the first axis and inhibits the extension of magnetic flux from that pole and encourages instead a deep extension of the magnetic flux from the other pole. An aperture penetrates the magnet through the second axis which is wider at the pole away from the permalloy cap than it is at the pole adjacent to the permalloy cap. The shape of this aperture causes a distortion of the deeply extending magnetic flux lines at the pole away from the permalloy cap to be pinched inward toward the second axis rather than being parallel to it. The magnet thus provides a concentrated magnetic force that extends deeply out of its base so that the magnet can be placed on the exterior of a vessel or conduit with the result that the fluid inside is treated with optimized magnetic force.

3 Claims, 3 Drawing Sheets

METHOD OF MAKING A PERMANENT MAGNET

(b) CROSS-REFERENCE TO RELATED APPLICATIONS

This application is a divisional application of application Ser. No. 09/881,127 filed Jun. 13, 2001 now abandond, being examined in Art Unit 2832 and this divisional application is made pursuant to 37 C.F.R. 1.60. Applicants claim the benefit of the Jun. 13, 2001 filing date of the above named parent application pursuant to 35 U.S.C. 120.

(c) STATEMENT AS TO RIGHT TO INVENTIONS MADE UNDER FEDERALLY-SPONSORED RESEARCH AND DEVELOPMENT

This invention was not made under Federally Sponsored Research and Development. All rights are retained by the inventor.

(d) BACKGROUND OF THE INVENTION

1. Field of the Invention

This invention falls within the field of permanent magnets per se which are composed of Iron, Boron, and one or more rare earth elements. It also falls within the field of methods of treating fluids with permanent magnets since the whole purpose of this particular invention is to provide a permanent magnet with a powerful magnetic field shaped so as to extend deeply into a fluid reservior.

2. Description of Related Art Including Information Disclosed Under 37 CFR Sections 1.97 and 1.98

The related art contains inventions designed to remove iron particles from the oil of an engine. Typically, these are either magnetic drain plugs for the oil pan, magnets which are used to clean parts before clean oil is introduced, or magnets which are placed onto a part by a clamping device.

The related art also contains inventions which are used to treat fuels, making sure the ionization or oxygenation of the fuel is optimized so that efficiency of combustion is improved. Typically, these are cylindrical objects with axial passages through which the fuel passes. They will usually have a plurality of elongate magnets around the outside whose major axis is parallel to the direction of flow of the fuel. These magnets will have poles that are oriented in various way with respect to one another to achieve a pattern of magnetic field which the inventor considers to be an improvement over the art of the time.

The related art also contains inventions which are used to treat water, either to improve its purity for drinking or to remove wastes before it is discarded. These often tend to resemble the cylindrical objects with axial flow passages mentioned above as fuel treatment inventions. Again the magnets will be elongate and parallel to the flow direction. They sometimes have the difference that an eddy region will be provided in the flow path where the magnetic field is strong to aid in trapping the ferromagnetic particles. The related art also contains inventions in which the magnets are actually immersed in the water, either as vanes inside a treatment filter or as parts of a rotating drum which continually contacts the water with a different portion of its surface.

The related art also contains permanent magnets which are composed of Iron, Boron, and one or more rare earth elements in a mixture. The mixture may be stamped into a solid or it may be mixed with a binder such as a plastic which solidifies due to a chemical reaction. These magnets may be in the form of disks and the poles are usually but not always on opposite sides of a diameter of the disk. The magnets may also be in the form of oblongs and the pole may be axial, or on opposing major faces. Some of the magnets in the related art are surrounded with layers of other materials, usually calculated to prevent corrosion or assist in holding the magnet against the desired surface. The axis of orientation of the magnetic powder has been manipulated in the related art to provide magnets that minimize flux leakage from certain faces while providing powerful flux lines with deep reach from one or more other faces.

(e) SUMMARY OF THE INVENTION

This invention is a permanent magnet of the type R—Fe—B where R represents at least one of the Rare Earth Elements. The invention is manufactured in such a way that the magnetic force it projects is distorted to extend much farther out of the magnet's base than the magnet's top and it is further distorted so that the magnetism extending out of the base is concentrated by means of the flux lines converging toward the north/south axis rather than being parallel to the north/south axis. A Premalloy cap causes the extension of the flux lines to be greater out of the base of the magnet than out of the top. An axial aperture extending through the magnet causes the inward distortion of the flux lines by means of the axial aperture having a 45% widening trend in the direction of the base.

(f) BRIEF DESCRIPTION OF THE DRAWINGS

DESCRIPTION OF THE INVENTION AND ITS TYPICAL USES

Wear, metallic dirt particles, dirt ingested in the air intake and unburned Carbon turn oil into abrasive slurry that grinds down the parts of an engine. It is an object of this invention to produce a permanent magnet whose flux lines can reach deeply into the engine oil for the purpose of purifying it.

Fuel will burn more efficiently if it is treated with magnetism to improve its ionization and oxygenation. It is an object of this invention to provide a permanent magnet whose flux lines can reach deeply into fuel conduits to treat the fuel thereby improving combustion efficiency.

Water will often be contaminated with ferromagnetic particles and removal of these particles is desirable to improve the purity of water either prior to using it or discarding it. It is an object of this invention to provide a permanent magnet whose flux lines can reach deeply into water containers or conduits for the purpose of trapping impurities of Iron, Nickel and the like to purify the water.

In fact the uses for this magnet include all engines except 2-cycle, engine filters, manual transmissions, differentials, residential water heaters, water filters (including high purity industrial filters), hydraulics, gear boxes, bearings, air conditioners, air compressors, pneumatic controls, petrochemical vessels and conduits, textile filters, and portable power plants. Wherever fluids need to be treated with magnetism but it is undesirable to block fluid flow by placing a magnet in the flow path this invention will find ready application.

The invention is typically produced by the following process:

One) Prepare a mixture of a magnetic powder which contains Iron, Boron, and at least one Rare Earth Element, probably Neodymium.
Two) Cast the powder into the appropriate shape using a mold and thermal press.
Three) Coat the magnet with Copper.
Four) Coat the magnet with Nickle.
Five) Form a cap of Permalloy (preferably about 48% brass, 28% Nickel, and 22% Iron) onto the magnet like a cap.
Six) Injection molding the parts into a cohesive whole with a binding plastic.
Seven) Injection mold a high temperature GE plastic onto the magnet.
Eight) Cooling the magnet.
Nine) Magnetically activating the magnet.
Ten) Performing a magnetic force level test for quality control purposes.
Eleven) Packaging the magnet for sale.

(g) DESCRIPTION OF THE PREFERRED EMBODIMENT

Figure 1:
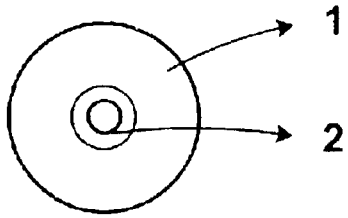
FIG. 1 shows the invention from the side having the broader mouth of the axial aperture.
Figure 2:
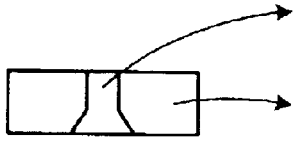
FIG. 2 is a cross sectional view of the invention showing the frustoconical or frustopyramidal shape of the aperture.
Figure 3:
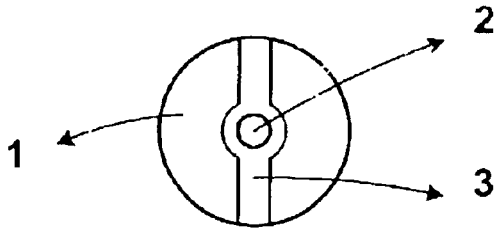
FIG. 3 shows the invention with its groove or recessed channel.
Figure 4:
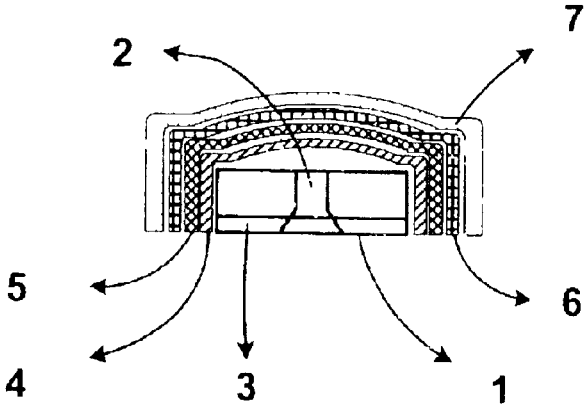
FIG. 4 is a cross sectional view of the invention showing the various layers of material formed onto the outside of the magnet.

The preferred embodiment of this invention is a Neodymium-Iron-Boron permanent magnet in which the magnetic portion is a flattened shape such as a disk or an oblong, most preferably a disk. Referring now to FIG. 1, the magnetic portion (1) (or "disk") can be seen from one of the substantially planar surfaces. An aperture (2) penetrates the disk axially so that the magnet forms a ring. In cross section shown at FIG. 2, it can be seen that the aperture (2) is not cylindrical, but instead diverges or becomes wider toward the base of the magnet at a 45 degree angle. Referring now to FIG. 3, it can be seen that there is also a channel (3) cut across the base along a diameter so that it intersects the aperture (2) (since the aperture is located at the center of the circle that defines the disk). The channel (3) does not extend through the disk from top to bottom, but is instead in the nature of a groove. Referring now to FIG. 4, it can be seen that the top and sides of the magnet, but not the bottom are coated in Copper (4). The top and sides then contain a layer of Nickel (5) deposited over the layer of Copper. Iron or brass may be substituted for the Copper or Nickel. The top and sides of the magnet then have a layer of Permalloy (6) deposited over the layer of Nickel. The preferred composition of the Permalloy is 48% Brass, 28% Nickel, and 22% Iron.

Figure 5:
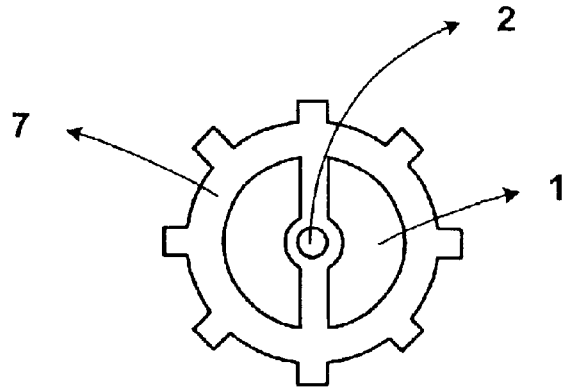
FIG. 5 shows the invention with its layer of high temperature plastic covering all sides not facing the viewer, as well as filling the groove or recessed channel.

Plastic (7) is molded over this article of manufacture for the dual purposes of holding it together and forming a fuse so that the magnet will not function properly in excessive temperatures, thereby removing the temptation to misuse the magnet. The way the plastic is molded onto the article is that the entire top and sides are covered, but the bottom is uncovered except that plastic is in the groove or channel in the base, filling this channel until the plastic is flush with the base. As can be seen at FIG. 5, the plastic (7) fills the groove but not the aperture (2). This outer layer of plastic is of a type which is usable up to temperatures of 220 degrees centigrade. When the temperature exceeds this, the plastic in the channel melts and fuses across the aperture, thereby impairing the performance of the magnet.

Figure 6:
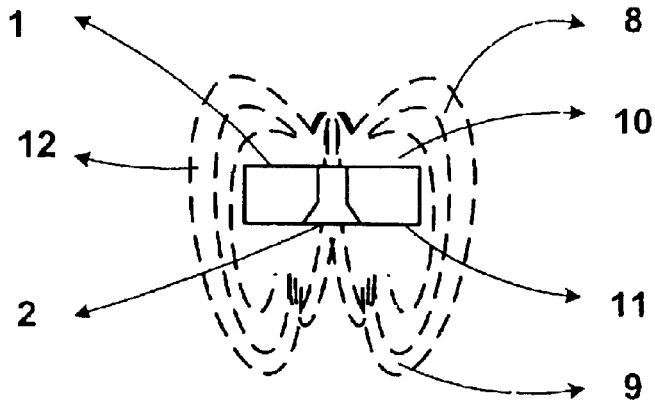
FIG. 6 shows the angular inward compression of the magnetic flux lines caused by the larger opening of the frustoconical or frustopyramidal aperture.
Figure 7:
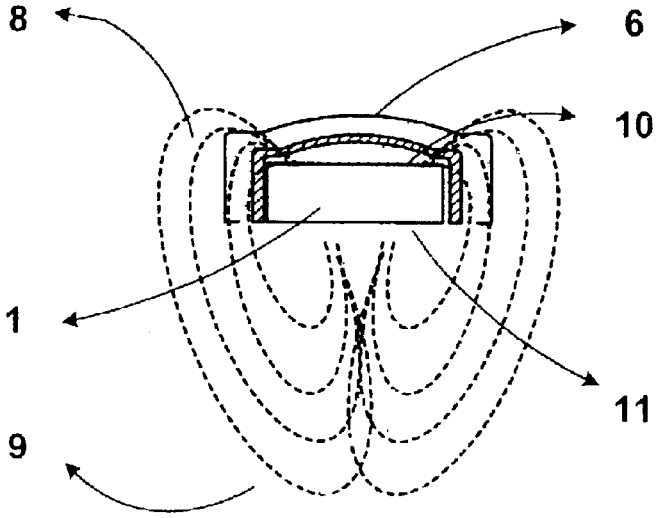
FIG. 7 shows the damping of the magnetic flux lines caused by the permalloy cap and the accompanying amplification of the flux lines away from the cap.

Magnetically speaking, the high performance of this invention is achieved in part by the 45% outward flaring of the aperture at the base of the magnet and in part by the permalloy cap. Referring now to FIG. 6, This Figure shows the invention has first magnetic poles (8) and second magnetic poles (9), a top surface (10), a side surface (11), and a bottom surface (12). The wider mouth of the aperture is associated with the bottom surface. Axial compression of the magnetic flux lines (13) are seen in the region of the second magnetic pole (9). If the disk is considered a cylinder, the poles are at opposite ends of a line through the axis of the cylinder. In the case of a simple cylinder, the magnetic flux lines would extend equally distant in the direction of both the north and south poles. The flux lines would also be symmetrical. In the preferred embodiment, the Permalloy cap forces the flux lines to extend farther in the direction away from the cap. This can be seen in FIG. 7. The permalloy (6) damps the first magnetic pole (8) which in turn results in an amplification of the second magnetic pole (9). Typically, if the cap is at north, rather than a situation exhibiting magnetic force of N+5 and S+5, there would instead be force of N+2 and S+8, or in other words much more of the magnetic force being projected out of the bottom surface of the magnet than out of its top surface. The 45% outward flaring of the aperture at the base of the magnet distorts the lines of magnetic flux so that rather than being parallel to the axis of the aperture so a 90 degree angle is formed with the plane that bisects the disk, the flux lines extending out the top of the magnet form a 112 degree angle with the bisecting plane while the flux lines extending from the base of the magnet form a 68 degree angle with the bisecting plane. Said another way, the flux lines extending out the top of the magnet are distorted away from the axis of the aperture while the flux lines extending out the bottom of the magnet are distorted inward toward the axis of the aperture. The result of all this is that a powerful cone-like field of magnetic force is directed deep into whatever vessel the base of the magnet is placed against.

Figure 8:
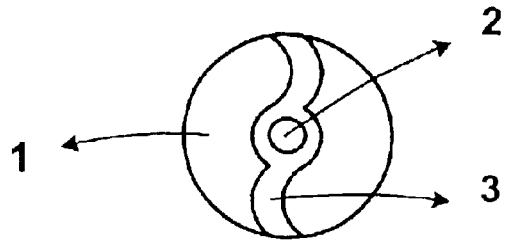
FIG. 8 shows the recessed channel or groove in an alternative embodiment to the linear form seen at FIGS. 3 and 5.
Figure 9:
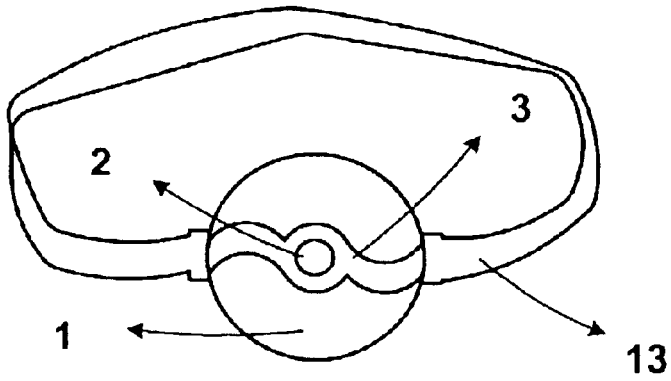
FIG. 9 shows the invention can be used with an elastic band to hold it on plastic conduits and other non-magnetic surfaces.
Figure 10:
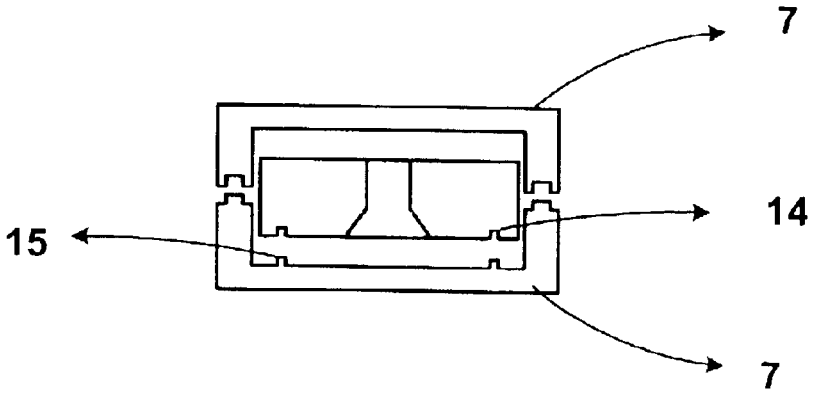
FIG. 10 is a cross sectional partially exploded view of the invention showing an alternative embodiment of how the high temperature plastic fills grooves or notches on the magnet.

Turning now to FIG. 8, it can be seen that the groove (3) need not be linear, but may be cut in alternative configurations. At FIG. 9, a band (14) is shown by which the invention may be held onto surfaces to which the magnet will not automatically adhere, such as plastic conduits or water softeners. This band may be unitary in construction or have two ends that fasten somehow. It may be elastic. Turning now to FIG. 10, an alternative tongue-in-groove formation can be seen by which the plastic (7) has projections (15)

which fit into slots (16) in the bottom surface of the magnet. These slots may be in the groove, if there is a groove in the bottom surface of the magnet. This alternative configuration is another way the plastic can be held securely onto the magnet and can securely hold the magnet construction together.

We claim:

1. An improved process of manufacturing a permanent magnet of the type including the steps of providing a magnetic powder; providing a binder resin; molding said permanent magnet; cooling said permanent magnet; and activating said permanent magnet magnetically wherein the improvement comprises:

penetrating said permanent magnet with a substantially frustoconical axial aperture; and coating at least one surface of said permanent magnet with a layer of permalloy.

2. An improved process of manufacturing a permanent magnet of the type including the steps of providing a magnetic powder; providing a binder resin; molding said permanent magnet; cooling said permanent magnet; and activating said permanent magnet magnetically wherein the improvement comprises:

penetrating said permanent magnet with a substantially frustoconical axial aperture;

coating at least one surface of said permanent magnet with a layer of permalloy; and coating said at least one surface of said permanent magnet with a layer of nickel prior to said step of coating said at least one surface of said permanent magnet with said layer of permalloy.

3. An improved process of manufacturing a permanent magnet of the type including the steps of providing a magnetic powder; providing a binder resin; molding said permanent magnet; cooling said permanent magnet; and activating said permanent magnet magnetically wherein the improvement comprises:

penetrating said permanent magnet with a substantially frustoconical axial aperture;

coating at least one surface of said permanent magnet with a layer of permalloy;

coating said at least one surface of said permanent magnet with a layer of nickel prior to said step of coating said at least one surface of said permanent magnet with said layer of permalloy; and coating said at least one surface of said permanent magnet with a layer of copper prior to said step of coating said at least one surface of said permanent magnet with said layer of nickel.

* * * * *